US006584173B2

(12) United States Patent
Zwart et al.

(10) Patent No.: US 6,584,173 B2
(45) Date of Patent: Jun. 24, 2003

(54) X-RAY EXAMINATION DEVICE COMPRISING A MANUALLY ADJUSTABLE FILTER

(75) Inventors: Paul Zwart, Eindhoven (NL); Robert Derk Jan Hendrik Hofsink, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 23 days.

(21) Appl. No.: 09/955,251

(22) Filed: Sep. 18, 2001

(65) Prior Publication Data

US 2002/0051516 A1 May 2, 2002

(30) Foreign Application Priority Data

Sep. 21, 2000 (EP) ..... 00203308

(51) Int. Cl.[7] ..... G21K 3/00
(52) U.S. Cl. ..... 378/158; 378/156; 378/159
(58) Field of Search ..... 378/145, 156, 378/157, 158, 159

(56) References Cited

U.S. PATENT DOCUMENTS 5,625,665 A 4/1997 Fokkink et al. ..... 378/156
6,061,426 A * 5/2000 Linders et al. ..... 378/149
6,106,152 A 8/2000 Thunberg ..... 378/205
6,188,749 B1 * 2/2001 Schiller et al. ..... 378/158
6,252,939 B1 * 6/2001 Young et al. ..... 378/156
6,289,081 B1 * 9/2001 Weekamp et al. ..... 378/156
6,370,228 B1 * 4/2002 Mockler et al. ..... 378/158

* cited by examiner

*Primary Examiner*—Drew A. Dunn
*Assistant Examiner*—Allen C. Ho
(74) *Attorney, Agent, or Firm*—John Vodopia

(57) ABSTRACT

The invention concerns an X-ray examination device, including an X-ray source and an X-ray detector, for forming an X-ray image of an object, an X-ray filter, arranged between the X-ray source and the X-ray detector, and adjusting circuit, connected to the X-ray filter for adjusting it. The adjusting circuit comprises a graphics device, cursor control for defining a region of interest in an image of the object, displayed on the graphics device, and image-processing unit, connected to the X-ray filter, for calculating the region of interest and adjusting the filter accordingly. The X-ray filter includes filter elements having an X-ray absorptivity which can be adjusted by controlling a quantity of X-ray absorbing liquid within the individual filter elements. The filter elements are capillary tubes, and adjusting circuit applies electric voltages to the individual capillary tube for controlling the quantity of X-ray absorbing liquid in the tube.

12 Claims, 3 Drawing Sheets

X-RAY EXAMINATION DEVICE COMPRISING A MANUALLY ADJUSTABLE FILTER

BACKGROUND OF THE INVENTION

1. Field of the Invention

The present invention relates to an X-ray examination device, including an X-ray source and an X-ray detector, for forming an X-ray image of an object to be examined by exposure of said object to X-rays, an X-ray filter, which is arranged between the X-ray source and the X-ray detector for filtering the X-rays passing through said object, and adjusting means, which are connected to the X-ray filter for adjusting the X-ray filter, which adjusting means comprise a graphics device, cursor control means for defining a region of interest in an image of said object, displayed on said graphics device, and processing means, which are connected to the X-ray filter, for calculating the region of interest and adjusting the filter accordingly, the X-ray filter including a plurality of filter elements having an X-ray absorptivity which can be adjusted by controlling a quantity of X-ray absorbing liquid within the individual filter elements.

2. Description of the Prior Art

Such an X-ray examination device is known from the international patent application WO 98/27867.

The known X-ray examination device uses, among other alternatives, transparent passages as filter elements, which are aligned at right angles to the direction of the X-rays. Each passage is filled alternately by means of pumps with a substance, which is either transparent to X-rays or non-transparent thereto. Thus a contour can be formed in accordance with a region of interest defined by an operator.

The known X-ray examination device has several disadvantages. One of them is that the passages only allow for a rough control of the filter, since the accuracy with which the region of interest can be reproduced by the filter elements is not only limited by the size and form of the passages, but also by the separation line between the transparent and non-transparent substances. Furthermore a large amount of pumps are necessary to fill all individual passages, which raises the complexity and costs of the device. On top of this filling, the passages alternately with the transparent or the non-transparent substance requires several fillings per passage, which is time consuming and makes the control difficult, thereby further raising the overall complexity and accompanying costs.

SUMMARY OF THE INVENTION

The invention aims at providing an X-ray examination device of the type described above, which does not have these drawbacks.

The X-ray examination device according to the invention is characterized in that the filter elements are capillary tubes, and means for applying electric voltages to the individual capillary tubes are provided for controlling the quantity of X-ray absorbing liquid therein.

The small size of the capillary tubes makes it possible to define a region of interest in many different shapes thus allowing for fine-tuning the filter elements. The control is performed by applying electrical voltages, making the use of large mechanical elements, such as pumps, redundant.

It must be noted that an X-ray examination device, including an X-ray source and an X-ray detector, for forming an X-ray image of an object to be examined by exposure of said object to X-rays, an X-ray filter, which is arranged between the X-ray source and the X-ray detector for filtering the X-rays passing through said object, and adjusting means, which are connected to the X-ray filter for adjusting the X-ray filter, the X-ray filter including a plurality of filter elements having an X-ray absorptivity which can be adjusted by controlling a quantity of X-ray absorbing liquid within the individual filter elements, wherein the filter elements are capillary tubes, and means for applying electric voltages to the individual capillary tubes are provided for controlling the quantity of X-ray absorbing liquid therein, is in itself known from U.S. Pat. No. 5,625,665 from the same applicant. The known device lacks the adjusting and processing means of the device according to the invention. In the known device the filter elements are adjusted automatically on the basis of brightness values of the X-ray images and/or on the basis of the settings of the X-ray source.

Contrary to this according to the invention adjustment of the filter elements can also be performed directly by the operator. By means of a graphics device and cursor control means he or she can define the desired region of interest in an image of the object which must be subjected to the X-rays, or, alternatively, should be screened therefrom. Thus the X-ray examination device according to the invention allows for fine tuning the filter in a variety of ways.

According to a first preferred embodiment of the X-ray examination device according to the invention the capillary tubes are aligned essentially parallel to the X-rays emanating from the X-ray source. According to a second preferred embodiment of the X-ray examination device according to the invention the capillary tubes are aligned essentially parallel to one another. In both embodiments the region of interest is build up in the filter by means of 'X-ray absorbing dots' formed essentially by the cross section of the capillary tubes. This cross section being very small the fine tuning possibilities are further enhanced.

In a further preferred embodiment the capillary tubes are filled with one liquid. According to the X-ray examination device of the invention only one liquid suffices to create the desired filter. This greatly simplifies the control and enhances the speed of adjustment. According to an elegant embodiment of the X-ray examination device according to the invention means are provided to control the height of the liquid in the capillary tubes based on the degree of overlapping portions in the region of interest defined on the graphics device.

According to an alternative embodiment means are provided to control the height of the liquid in the capillary tubes based on the pressure exerted on the graphics device during definition of the region of interest on the graphics device. Both embodiments allow for a quick and user-friendly way to influence the degree of absorptivity over de region of interest. Preferably the adjusting means comprise a touch screen, which incorporates both the graphics device and the cursor control means and allows for easy and comfortable navigation by the operator. Most preferably the touch screen is pressure sensitive thereby facilitating local adjustment of the X-ray absorptivity of the filter by locally exerting varying amounts of pressure while drawing the region of interest on the touch screen.

According to a still further preferred embodiment the processing means are arranged to calculate a region of interest based on an open contour by calculating the missing part and closing the contour, the closed contour defining the region of interest. Alternatively the processing means are arranged to calculate a region of interest based on a line and a certain area surrounding the line. In practice these will be useful options to quickly and easily define a region of interest.

BRIEF DESCRIPTION OF THE DRAWINGS

The invention will be further explained by means of the attached drawings, in which.

DETAILED DESCRIPTION OF THE PREFERRED EMBODIMENTS

Figure 1:
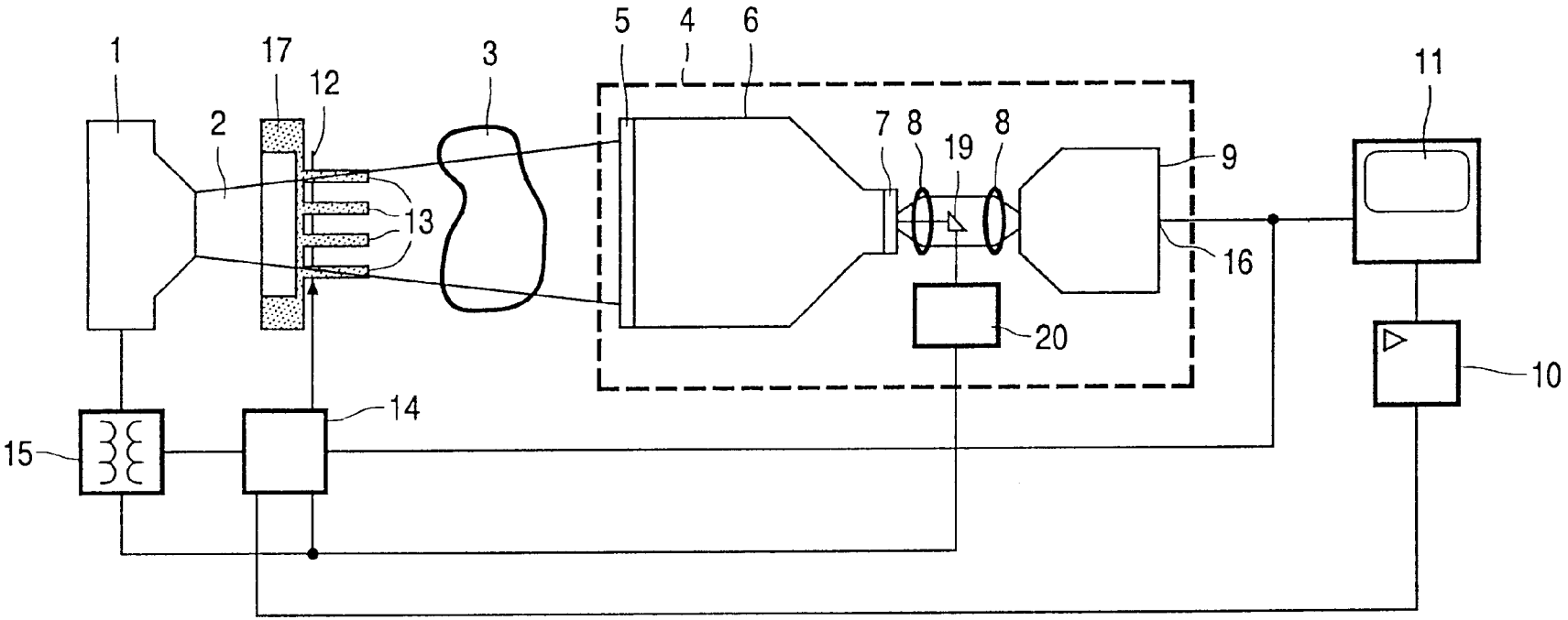
FIG. 1 shows diagrammatically a preferred embodiment of an X-ray examination device according to the invention.

FIG. 1 shows diagrammatically an X-ray examination apparatus in accordance with the invention. The X-ray source 1 emits an X-ray beam 2 whereto an object 3, for example a patient to be examined, is exposed. As a result of local differences in the absorption of X-rays in the object 3 an X-ray image is formed on the X-ray detector 4, which is in this case an image intensifier pick-up chain. The X-ray image is formed on the entrance screen 5 of the X-ray intensifier 6 and is converted into a light image on the exit window 7, which light image is imaged on a video camera 9 by means of a lens system 8. The video camera 9 forms an electronic image signal from the light image. The electronic image signal is applied, for example for further processing to an image-processing unit 10 or the monitor of graphics device 11 on which the image information in the X-ray image is displayed. Between the X-ray source 1 and the object 3 there is arranged the filter 12 for local attenuation of the X-ray beam 2 by means of various filter elements 13 in the form of capillary tubes whose X-ray absorptivity can be adjusted by application of electric voltages to the inner side of the capillary tubes by means of an adjusting circuit 14. The electric voltages can be automatically adjusted by the adjusting circuit 14 on the basis of for example brightness value of the X-ray image and/or the basis of the setting of the X-ray source. To this end the adjusting circuit is coupled to the power supply 15 of the X-ray source and to the output terminal 16 of the video camera 9.

Part of the light of the exit window is guided, by way of a splitting prism 19, to an exposure control system 20 which derives a control signal from the light image in order to control the high-voltage supply on the basis of image information of the image on the exit window. In order to receive image information of the image on the exit window 7, the adjusting circuit 14 of the filter 12 is coupled to the exposure control system 20, so that the filter 12 can be adjusted on the basis of the image on the exit window 7. The filter is constructed, for example in such a manner that the capillary tubes extend approximately parallel to the direction of the X-ray beam 2; a uniform spatial resolution of the spatial X-ray Absorption pattern is thus achieved across the cross-section of the X-ray beam. Alternatively the filter can also be constructed in such a manner that the capillary tubes extend approximately parallel to one another; when the X-ray beam diverges, it is thus achieved that substantially all X-rays pass at least partly through a capillary tube, so that X-rays cannot pass between two tubes without being attenuated. The adjusting circuit applies electric voltages to the inner sides of the capillary tubes so as to influence the adhesion of the X-ray absorbing liquid to the inner sides. In order to adjust a filter element to a high X-ray absorptivity an electric voltage of the first value is applied to the inner side of the capillary tubes of the relevant filter element by the adjusting circuit 14, the relevant capillary tubes then being filled with the X-ray absorbing liquid from the reservoir 17 by strong adhesion of the X-ray absorbing liquid to the inner side. In order to adjust a filter element to a low X-ray absorptivity the adjusting circuit 14 applies an electric of the voltage of the second value, for example equal to the potential of a reference electrode (for example a standard calomel electrode) in the X-ray absorbing liquid, to the inner side of the capillary tubes of the relevant filter element, the X-ray absorbing liquid then exhibiting poor adhesion to the relevant capillary tubes, so that these capillary tubes are not filled with the X-ray absorbing liquid from the reservoir 17. A filter element may also comprise a group of several capillary tubes and the X-ray absorptivity of the filter element is then adjustable by adjustment of the fraction of capillary tubes of said group filled with the X-ray absorbing liquid by application of an electric voltage of the first value to the capillary tubes of the fraction and by application of the second voltage value to the remaining capillary tubes of the group. The adjusting circuit adjusts the filter elements to X-ray absorptivities for which the brightness values of the X-ray image are within a predetermined range, for example in conformity with the range of brightness values of the light image that can be handled by the video camera 9 without introducing disturbances in the electronic image signal. Filter elements which are traversed by a part of the X-ray beam which is strongly attenuated by the object are adjusted to a low X-ray absorptivity and filter elements which are traversed by a part of the X-ray beam which is transmitted well by the object are adjusted to a high X-ray absorptivity.

The X-ray examination device itself and the functioning thereof are described in more detail in U.S. Pat. No. 5,625,665 of the same applicant, which is incorporated herein by reference. In practice there are often situations in which it is desirable to create X-ray images of a specific part of the object 3. For example when a patient is examined by a physician, the physician may wish to create a detailed X-ray image of a specific (part of an) organ of the patient. According to the invention an operator can manually define an area in the image of object 3 as displayed on graphics device 11, which area is to be reproduced. In the context of this invention this area is called the 'region of interest (ROI). Generally this region of interest will be an area which should be subjected to X-rays. Of course this area could also be an area which should be screened from X-rays. In order to define this region of interest the graphics device 11 is equipped with cursor control means (not shown).

Preferably graphics device 11 comprises a touch screen. In this case the operator can define the region of interest literally manually, e.g. with a pen or with his fingers. Examples of other suitable cursor control means are a mouse or a keyboard. Further more processing means 10 are provided, which are connected to the adjusting means 14 and the X-ray filter 12. The processing means are arranged for calculating the ROI defined on the graphics device on the basis of which the filter can be adjusted accordingly. The processing means comprise specific software and hardware to perform the calculations. Thereto the graphics device 11 sends an electronic signal to the processing means containing information about the ROI defined by the operator in the image displayed on the graphics device 11. This can be realized in various ways, which are known to a person skilled in the art. As a result of the calculations the processing means send a control signal to the adjusting circuit 14 on the basis of which the X-ray filter 12 is adjusted. This adjustment is realized in a similar way as the adjustment of the X-ray filter based on a signal coming from the output terminal 16 of the video camera 9 or the exposure control system 20, as described above and in U.S. Pat. No. 5,625,665.

Figure 2A:
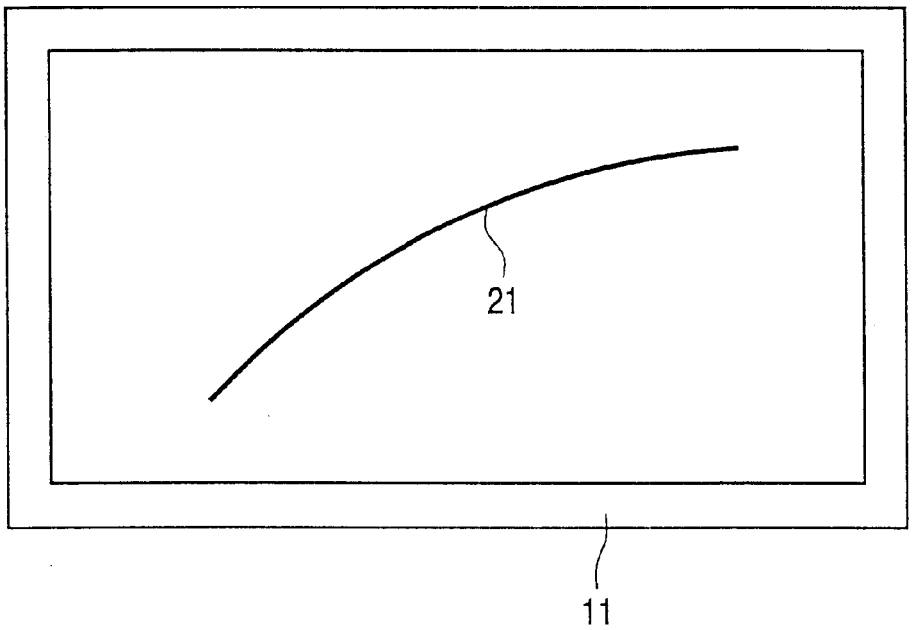
FIG. 2A shows an example of curved line defined on the graphics device by means of the cursor control means.

FIG. 2A describes an example of a curved line 21 defined on graphics device 11 by means of the cursor control means. Such a line can be easily and quickly drawn on a touch screen thus enabling a fast reproduction of the desired area of the X-ray image.

Figure 2B:
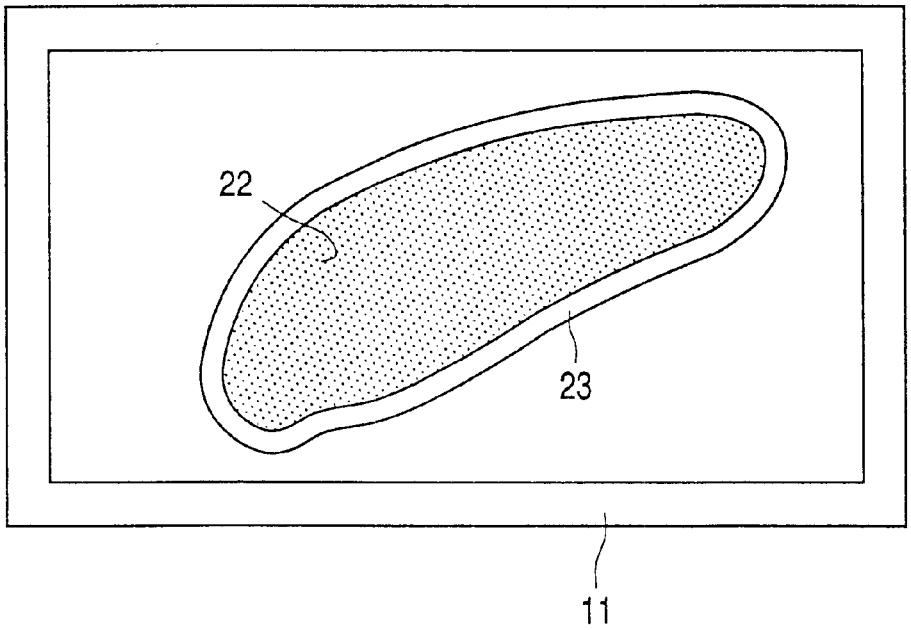
FIG. 2B shows the screening resulting from the line defined in FIG. 2A.

FIG. 2B shows the screening resulting from the contour 21 defined in FIG. 2A. The processing means 10 have calculated a ROI 23 defined by the curved line 21 plus a certain area surrounding it. The form and size of the surrounding area are programmable into the software. In this case the area surrounds an organ 22 which should be reproduced.

Figure 3A:
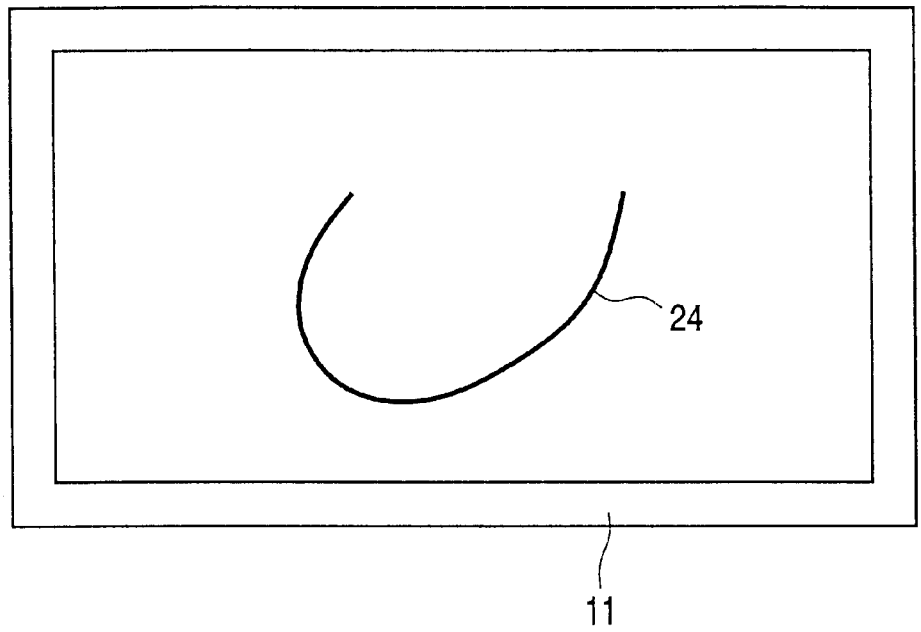
FIG. 3A shows an example of an open contour defined on the graphics device by means of the cursor control means.

FIG. 3A describes an example of an open contour 24 defined on graphics device 11 by means of the cursor control means. In the context of the invention an open contour is defined as a contour which is not endless. Such a contour can be easily and quickly drawn on a touch screen thus enabling a fast reproduction of the desired area of the X-ray image.

Figure 3B:
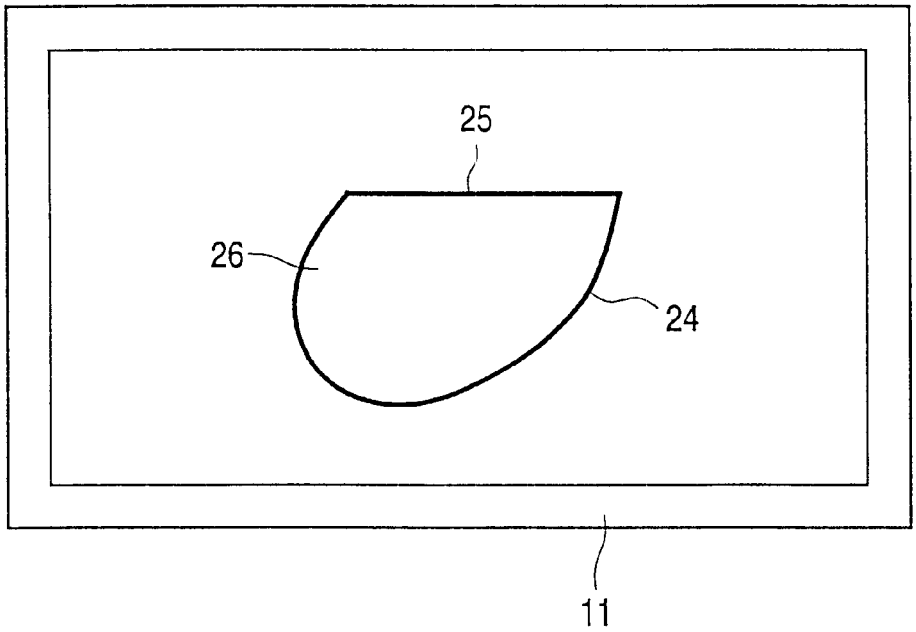
FIG. 3B shows the screening resulting from the contour defined in FIG. 3A.

FIG. 3B shows the screening resulting from the contour 24 defined in FIG 3A. The processing means 10 have calculated the missing part 25 and closed the contour 24 so that it defines a ROI 26. The way in which the missing part 25 is calculated is programmable into the software.

According to the invention the filter can thus be adjusted automatically as well as manually on the basis of a first image of the object to be examined, which is usually made by means of low intensity X-rays. In the above described preferred embodiment said first image is, respectively, the image on the exit window or the same image displayed on the graphics device. In practice it is expected that in specific cases, when the operator prefers to adjust the filter manually, the automatic filter adjustment will be overruled by the operator with suitable means.

Preferably the X-ray examination device according to the invention is arranged such that it allows for the degree of X-ray absorptivity by the filter to be set by adjusting the height of X-ray absorbing liquid in the capillary tubes. The operator can then set the degree of X-ray absorptivity by the way the ROI is indicated on the graphics device. In a first preferred embodiment the ROI is drawn in at least partially overlapping portions or several ROI's are drawn, which partially overlap. The degree of overlap is now indicative for the resulting degree of X-ray absorptivity by the filter. According to a second preferred embodiment the touch screen is pressure sensitive and the operator draws an ROI while locally exerting varying amounts of pressure, the amount of pressure being indicative for the resulting local degree of X-ray absorptivity by the filter. Programming the two described preferred embodiments into the software will present no specific problems to a person skilled in the art.

Summarizing the invention provides an X-ray examination device with a user-friendly filter that is adjustable, manually and/or automatically, at high speed with great accuracy and allows an operator a great variety of tuning possibilities for the desired region of interest. The invention is of course not limited to the described or shown embodiment(s), but generally extends to any embodiment, which falls within the scope of the appended claims as seen in light of the foregoing description and drawings

What is claimed is:

1. An X-ray examination device comprising an X-ray source and an X-ray detector, for forming an X-ray image of an object to be examined by exposure of said object to X-rays, an X-ray filter, which is arranged between the X-ray source and the X-ray detector for filtering the X-rays passing through said object, and adjusting means, which are connected to the X-ray filter for adjusting the X-ray filter, said adjusting means comprising a graphics device, cursor control means for defining a region of interest in an image of said object displayed on said graphics device, and processing means connected to the X-ray filter for calculating the region of interest and adjusting the filter accordingly, the X-ray filter including a plurality of filter elements having an X-ray absorptivity which can be adjusted by controlling a quantity of X-ray absorbing liquid within the individual filter elements, the filter elements are capillary tubes, and said X-ray examination device further comprising means for applying electric voltages to the individual capillary tubes for controlling the quantity of X-ray absorbing liquid therein.

2. An X-ray examination device according to claim 1, wherein the capillary tubes are aligned essentially parallel to the X-rays emanating from the X-ray source.

3. An X-ray examination device according to claim 1, wherein the capillary tubes are aligned essentially parallel to one another.

4. An X-ray examination device according to claim 1, 2 or 3, wherein the capillary tubes are filled with one liquid.

5. An X-ray examination device according to claim 1, wherein means are provided to control the height of the liquid in the capillary tubes based on the degree of overlapping portions in the region of interest defined on the graphics device.

6. An X-ray examination device according to claim 1, wherein means are provided to control the height of the liquid in the capillary tubes based on the pressure exerted on the graphics device during definition of the region of interest on the graphics device.

7. An X-ray examination device according to claim 1, wherein the graphics device comprises a touch screen.

8. An X-ray examination device according to claim 7, wherein the touch screen is pressure sensitive.

9. An X-ray examination device according to claim 1, wherein the processing means are arranged to calculate a region of interest defined by an open contour.

10. An X-ray examination device according to claim 9, wherein the open contour is a line and the processing means are arranged to calculate a region of interest based on said line and a certain area surrounding it.

11. An apparatus for adjusting an X-ray filter of an X-ray examination device having an X-ray source and an X-ray detector for forming an X-ray image of an object to be examined by exposure of said object to X-rays, an X-ray filter which is arranged between the X-ray source and the X-ray detector for filtering the X-rays passing through said object, said apparatus comprising:

cursor control means for defining a region of interest in an image of said object displayed on a display; and processing means for calculating the region of interest and adjusting the X-ray filter accordingly.

12. A method for adjusting an X-ray filter of an X-ray examination device having an X-ray source and an X-ray detector for forming an X-ray image of an object to be examined by exposure of said object to X-rays, an X-ray filter which is arranged between the X-ray source and the X-ray detector for filtering the X-rays passing through said object, said method comprising:

defining a region of interest in an image of said object displayed on a display;

calculating the region of interest; and adjusting the X-ray filter according to the calculated region of interest.

* * * * *